US009914990B2

(12) United States Patent
Yamashita et al.

(10) Patent No.: US 9,914,990 B2
(45) Date of Patent: Mar. 13, 2018

(54) STEEL FOR MECHANICAL STRUCTURE FOR COLD WORKING, AND METHOD FOR MANUFACTURING SAME

(71) Applicant: Kobe Steel, Ltd., Kobe-shi (JP)

(72) Inventors: Koji Yamashita, Kobe (JP); Takehiro Tsuchida, Kobe (JP); Masamichi Chiba, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 631 days.

(21) Appl. No.: 14/387,906

(22) PCT Filed: Apr. 4, 2013

(86) PCT No.: PCT/JP2013/060357
§ 371 (c)(1),
(2) Date: Sep. 25, 2014

(87) PCT Pub. No.: WO2013/161538
PCT Pub. Date: Oct. 31, 2013

(65) Prior Publication Data

US 2015/0041029 A1 Feb. 12, 2015

(30) Foreign Application Priority Data

Apr. 24, 2012 (JP) ..... 2012-098774

(51) Int. Cl.

| | |
|---|---|
| ***C22C 38/46*** | (2006.01) |
| ***C21D 1/00*** | (2006.01) |
| ***C22C 38/42*** | (2006.01) |
| ***C22C 38/32*** | (2006.01) |
| ***C22C 38/28*** | (2006.01) |
| ***C22C 38/00*** | (2006.01) |
| ***C22C 38/24*** | (2006.01) |
| ***C22C 38/22*** | (2006.01) |
| ***C22C 38/06*** | (2006.01) |
| ***C22C 38/04*** | (2006.01) |
| ***C22C 38/02*** | (2006.01) |
| ***C21D 8/06*** | (2006.01) |
| ***C22C 38/60*** | (2006.01) |
| ***C21D 6/00*** | (2006.01) |
| ***C22C 38/18*** | (2006.01) |
| ***C22C 38/26*** | (2006.01) |
| ***C22C 38/40*** | (2006.01) |
| ***C21D 1/32*** | (2006.01) |
| ***C21D 8/00*** | (2006.01) |
| *C21D 9/52* | (2006.01) |

(52) U.S. Cl.

CPC ..... *C22C 38/46* (2013.01); *C21D 1/00* (2013.01); *C21D 1/32* (2013.01); *C21D 6/002* (2013.01); *C21D 8/005* (2013.01); *C21D 8/06* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/18* (2013.01); *C22C 38/22* (2013.01); *C22C 38/24* (2013.01); *C22C 38/26* (2013.01); *C22C 38/28* (2013.01); *C22C 38/32* (2013.01); *C22C 38/40* (2013.01); *C22C 38/42* (2013.01); *C22C 38/60* (2013.01); *C21D 9/52* (2013.01); *C21D 2211/005* (2013.01); *C21D 2211/009* (2013.01)

(58) Field of Classification Search

CPC ..... C22C 38/00; C22C 38/001; C22C 38/002; C22C 38/02; C22C 38/04; C22C 38/06; C22C 38/18; C22C 38/22; C22C 38/24; C22C 38/26; C22C 38/28; C22C 38/32; C22C 38/40; C22C 38/42; C22C 38/46; C22C 38/60; C21D 1/00; C21D 1/32; C21D 6/002; C21D 8/005; C21D 8/06; C21D 9/52; C21D 2211/005; C21D 2211/009

See application file for complete search history.

(56) References Cited

U.S. PATENT DOCUMENTS

| | | | |
|---|---|---|---|
| 4,702,778 | A | 10/1987 | Takahashi et al. |
| 4,753,691 | A | 6/1988 | Tarui et al. |
| 2002/0179193 | A1 | 12/2002 | Yokoi et al. |

FOREIGN PATENT DOCUMENTS

| | | | |
|---|---|---|---|
| CN | 102227512 | A | 10/2011 |
| GB | 2 187 202 | A | 9/1987 |
| GB | 2 208 654 | A | 4/1989 |

(Continued)

OTHER PUBLICATIONS

Hiroshi et al., English machine translation of JP 2000-119809, Apr. 2000, p. 1-16.*

(Continued)

*Primary Examiner* — Xiaowei Su

(74) *Attorney, Agent, or Firm* — Oblon, McClelland, Maier & Neustadt, L.L.P.

(57) ABSTRACT

The present invention is a steel for a mechanical structure for cold working, the steel characterized in containing C, Si, Mn, P, S, Al, N, and Cr, the remainder being iron and inevitable impurities; the metal composition having pearlite and pro-eutectoid ferrite; the combined area of the pearlite and pro-eutectoid ferrite being 90% or more of the total composition; the area percentage A of the pro-eutectoid ferrite having the relationship A>Ae, where Ae=(0.8−Ceq)×96.75 (Ceq=[C]+0.1×[Si]+0.06×[Mn]−0.11×[Cr], and "(element names)" indicates the element content (percent in mass); and the mean grain size of the pro-eutectoid ferrite and the ferrite in the pearlite being 15 to 25 μm.

12 Claims, No Drawings

(56) References Cited

FOREIGN PATENT DOCUMENTS

| | | | |
|---|---|---|---|
| JP | 4-131323 | | 5/1992 |
| JP | 2000-119809 | | 4/2000 |
| JP | 2001-89830 | | 4/2001 |
| JP | 2001-234284 | A | 8/2001 |
| JP | 2001-303186 | A | 10/2001 |
| JP | 2002-212667 | | 7/2002 |
| JP | 3474545 | | 12/2003 |
| JP | 2005-23366 | | 1/2005 |
| JP | 4842407 | B2 | 12/2011 |
| JP | 2012-7196 | A | 1/2012 |
| JP | 2013-7088 | | 1/2013 |
| JP | 2013-7089 | | 1/2013 |
| JP | 2013-7090 | | 1/2013 |
| JP | 2013-7091 | | 1/2013 |
| TW | I261072 | B | 9/2006 |
| TW | 201211268 | A1 | 3/2012 |

OTHER PUBLICATIONS

Extended European Search Report dated Dec. 18, 2015 in Patent Application No. 13781028.9.
International Search Report dated Jul. 9, 2013 in PCT/JP13/060357 Filed Apr. 4, 2013.
Written Opinion of the International Searching Authority dated Jul. 9, 2013 in PCT/JP13/060357 Filed Apr. 4, 2013.

* cited by examiner

STEEL FOR MECHANICAL STRUCTURE FOR COLD WORKING, AND METHOD FOR MANUFACTURING SAME

TECHNICAL FIELD

The present invention relates to a steel for a mechanical structure for cold working used for manufacturing various components such as components for automobiles, components for construction machines and the like, and relates more specifically to a steel low in deformation resistance after spheroidizing annealing and excellent in cold workability, and a method for manufacturing the same. More specifically, the present invention is for high strength wire rods and steel bars for a mechanical structure used for various components such as components for automobiles, components for construction machines and the like (for example machine components, transmission components and the like such as a bolt, screw, nut, socket, ball joint, inner tube, torsion bar, clutch case, cage, housing, hub, cover, case, receive washer, tappet, saddle, valve, inner case, clutch, sleeve, outer lace, sprocket, core, stator, anvil, spider, rocker arm, body, flange, drum, joint, connector, pulley, metal fitting, yoke, mouthpiece, valve lifter, spark plug, pinion gear, steering shaft, common rail and the like) manufactured by cold working such as cold forging, cold heading, cold rolling and the like for example, and can exert excellent cold workability because deformation resistance at room temperature and processing heat generation region in manufacturing the various components for a mechanical structure described above is low and a crack of the die and raw material can be suppressed.

BACKGROUND ART

In manufacturing various components such as components for automobiles, components for construction machines and the like, with the aim of imparting cold workability to hot rolled material such as carbon steel, alloy steel and the like, cold working is executed after spheroidizing annealing treatment is executed, thereafter cutting work and the like is executed for forming into a predetermined shape, quenching and tempering treatment is thereafter executed for final strength adjustment.

In recent years, there is a trend that the shape of the components becomes more complicated and larger, and, accompanying that, in cold working step, there is a request to further soften steel, to prevent cracking of steel, and to improve the life of a die. In order to further soften steel, although execution of spheroidizing annealing treatment for a longer time is also one method, from the viewpoint of energy saving, there is a problem in extending the heat treatment time excessively.

Several proposals have been also made so far with respect to steel for promoting spheroidizing. For example, in Patent Literature 1, it is disclosed that a steel wire rod containing pro-eutectoid ferrite and pearlite with the average grain size of 6-15 μm and with the volume percentage of pro-eutectoid ferrite being in a predetermined range can achieve both of quick spheroidizing annealing treatment and cold forgeability. However, when the microstructure is miniaturized, although the time for spheroidizing annealing treatment can be shortened, softening of the material when ordinary spheroidizing annealing treatment of approximately 10-30 hours is executed is insufficient.

On the other hand, in Patent Literature 2, a technology is disclosed in which softening is achieved as hot rolled by specifying the size of the dislocation cell and the grain size number of ferrite. However, this technology is also still insufficient in terms of further softening.

CITATION LIST

Patent Literature

Patent Literature 1: Japanese Unexamined Patent Application Publication No. 2000-119809

Patent Literature 2: Japanese Patent No. 3474545

SUMMARY OF INVENTION

Technical Problem

The present invention has been developed under such circumstances as described above, and its object is to provide a steel for a mechanical structure for cold working capable of achieving sufficient softening by performing ordinary spheroidizing annealing treatment and a method for manufacturing the same. The present invention is for alloy steel containing alloy elements such as Cr and the like in particular.

Solution to Problem

The present invention that achieved the object described above is a steel for a mechanical structure for cold working containing C: 0.2-0.6% (means mass %, hereinafter the same with respect to the chemical composition), Si: 0.01-0.5%, Mn: 0.2-1.5%, P: 0.03% or less (exclusive of 0%), S: 0.001-0.05%, Al: 0.01-0.1%, N: 0.015% or less (exclusive of 0%), and Cr: exceeding 0.5% and 2.0% or less, with the remainder being iron and inevitable impurities, in which the metal microstructure has pearlite and pro-eutectoid ferrite with the combined area percentage of the pearlite and pro-eutectoid ferrite being 90% or more of the total microstructure, the area percentage A of the pro-eutectoid ferrite has the relationship A>Ae with respect to Ae expressed by the expression (1) below, and the average grain size of the pro-eutectoid ferrite and ferrite in the pearlite is 15-25 μm.

$$Ae=(0.8-Ceq)\times 96.75 \quad (1)$$

where Ceq=[C]+0.1×[Si]+0.06×[Mn]+0.11×[Cr], and [(element name)] means the content (mass %) of each element.

It is also preferable that the steel for a mechanical structure for cold working of the present invention further contains, according to the necessity, one or more elements selected from the group consisting of Mo: 1% or less (exclusive of 0%), Ni: 3% or less (exclusive of 0%), Cu: 0.25% or less (exclusive of 0%), B: 0.010% or less (exclusive of 0%), Ti: 0.2% or less (exclusive of 0%), Nb: 0.2% or less (exclusive of 0%), and V: 0.5% or less (exclusive of 0%).

The present invention also includes a method for manufacturing the steel for a mechanical structure for cold working described above, and, more specifically, is a method for manufacturing the steel for a mechanical structure for cold working including the steps below after finish rolling a steel having the chemical composition of either of those described above at 850-1,100° C.:

(i) cooling to 720-780° C. with the average cooling rate of 10° C./s or more;

(ii) cooling thereafter to 680° C. or above with the average cooling rate of 1° C./s or less; and (iii) further cooling to 640° C. or below with the average cooling rate of 0.5° C./s or less.

Advantageous Effects of Invention

According to the present invention, various compositions are properly adjusted, the microstructure is made to have 90 area percent or more of pearlite and pro-eutectoid ferrite, the grain size of the ferrite (pro-eutectoid ferrite and ferrite in pearlite) and the area percentage of pro-eutectoid ferrite are made in a predetermined range, and therefore softening after spheroidizing annealing treatment can be achieved and the steel for a mechanical structure suitable to cold working can be provided.

DESCRIPTION OF EMBODIMENTS

The steel of the present invention has features in the points of (i) the microstructure having pearlite and pro-eutectoid ferrite and combined area percentage of pearlite and pro-eutectoid ferrite with respect to the total structure is 90% or more, (ii) the area percentage of pro-eutectoid ferrite exceeds 75% of equilibrium pro-eutectoid ferrite amount, and (iii) the average grain size of pro-eutectoid ferrite and ferrite in pearlite is 15-25 μm.

(i) on that Metal Microstructure is Microstructure Having Pearlite and Pro-Eutectoid Ferrite, and Combined Area Percentage of these Microstructures with Respect to Total Microstructure When the metal microstructure includes fine microstructure such as bainite, martensite and the like, even when general spheroidizing annealing is executed, after spheroidizing annealing, the microstructure becomes fine due to the effect of bainite and martensite and softening becomes insufficient. Therefore, the metal microstructure was made a microstructure having pearlite and pro-eutectoid ferrite, and the combined area percentage of these structures was stipulated to be 90 area % or more. The total area percentage of pearlite and pro-eutectoid ferrite is preferably 95 area % or more, more preferably 97 area % or more. Further, although martensite, bainite and the like that are possibly formed in the manufacturing process can be cited for example as the metal microstructure other than pearlite and pro-eutectoid ferrite, when the area percentage of these microstructures increases, the strength increases and cold workably possibly deteriorates, and therefore the contents of these microstructures are preferable to be as little as possible. Accordingly, the combined area percentage of pearlite and pro-eutectoid ferrite is most preferably 100 area %.

(ii) On Area Percentage of Pro-Eutectoid Ferrite

In the present invention, by securing the area percentage of pro-eutectoid ferrite before spheroidizing annealing as much as possible, cementite comes to be localized beforehand before spheroidizing annealing, spheroidizing of cementite is promoted by spheroidizing annealing, and thereby softening can be achieved. The present inventors studied the pro-eutectoid ferrite from the viewpoint of precipitating to the degree of the equilibrium amount, and clarified that the equilibrium pro-eutectoid ferrite amount could be expressed by (0.8−Ceq)×129 based on experiments. Also, it was found out that, in order to achieve softening after spheroidizing annealing, the pro-eutectoid ferrite amount of an amount exceeding 75% of the equilibrium pro-eutectoid ferrite amount described above is to be secured. More specifically, the area percentage A of pro-eutectoid ferrite in the present invention has the relationship of A>Ae with respect to Ae that is expressed by the expression (1) below.

$$Ae = (0.8 - Ceq) \times 129 \times 0.75 \quad (1)$$
$$= (0.8 - Ceq) \times 96.75$$

where Ceq=[C]+0.1×[Si]+0.06×[Mn]+0.11×[Cr], and [(element name)] means the content (mass %) of each element.

The area percentage A (%) of pro-eutectoid ferrite preferably satisfies the relationship of A (%)≥Ae (%)+0.5(%), A (%)≥Ae (%)+1.0(%) more preferably, and A (%)≥Ae (%)+1.5(%) particularly preferably. Also, the area percentage A (%) may satisfy the relationship of A (%)≤Ae (%)+5(%), and A (%)≤Ae (%)+3(%) particularly for example.

(iii) On Average Grain Size of Pro-Eutectoid Ferrite and Ferrite in Pearlite

The average grain size of pro-eutectoid ferrite and ferrite in pearlite is made 15 μm or more. Thus, softening after spheroidizing annealing becomes possible. On the other hand, when the average grain size becomes excessively large, the strength of regenerated pearlite and the like increases in ordinary spheroidizing annealing, and softening becomes difficult. Therefore, the average grain size of pro-eutectoid ferrite and ferrite in pearlite is made 25 μm or less. The lower limit of the average grain size is preferably 16 μM or more, more preferably 17 μm or more, and the upper limit is preferably 23 μm or less, and more preferably 21 μm or less.

In measuring the average grain size, the ferrite (pro-eutectoid ferrite and ferrite in pearlite) grains (bcc-Fe grains) surrounded by large angle grain boundaries in which the misorientation of two neighboring grains is larger than 15° are made the object. This is because, in the small angle grain boundary with 15° or less misorientation, the effect by spheroidizing annealing is small. By making the size of the ferrite grains surrounded by the large angle grain boundaries in which the misorientation is larger than 15° the range described above, sufficient softening can be achieved after spheroidizing annealing.

The average grain size described above means the average value of the diameters in being converted to a circle having same area (equivalent circle diameter). Also, the misorientation described above is what is called as "deviation angle" or "oblique angle", and for measuring the misorientation, the EBSP method (Electron Backscattering Pattern Method) can be employed.

Next, the chemical composition of the steel for a mechanical structure in relation with the present invention will be described.

C: 0.2-0.6%

C is an element useful in securing the strength of steel (the strength of the final product). In order to exert such an effect effectively, C amount was stipulated to be 0.2% or more. C amount is preferably 0.25% or more, and more preferably 0.30% or more. On the other hand, when C amount becomes excessively high, the strength increases excessively and cold workability deteriorates. Therefore, C amount was stipulated to be 0.6% or less. C amount is preferably 0.55% or less, and more preferably 0.50% or less.

Si: 0.01-0.5%

Si is an element having a deoxidizing action and effective in improving the strength of the final product by solid-solutionized hardening. In order to exert such an effect effectively, Si amount was stipulated to be 0.01% or more. Si amount is preferably 0.02% or more, and more preferably 0.03% or more (particularly 0.05% or more). On the other hand, when Si amount becomes excessively high, the strength increases excessively and cold workability deteriorates. Therefore, Si amount was stipulated to be 0.5% or less. Si amount is preferably 0.45% or less, and more preferably 0.40% or less.

Mn: 0.2-1.5%

Mn is an element effective in increasing the strength of the final product through improvement of quenchability. In order to exert such an effect effectively, Mn amount was stipulated to be 0.2% or more. Mn amount is preferably 0.3% or more, and more preferably 0.4% or more. On the other hand, when Mn amount becomes excessively high, the hardness increases excessively and cold workability deteriorates. Therefore, Mn amount was stipulated to be 1.5% or less. Mn amount is preferably 1.1% or less, and more preferably 0.9% or less.

P: 0.03% or Less (Exclusive of 0%)

P is an element inevitably contained in steel, and is an element causing grain boundary segregation in steel and becoming a cause of deterioration of ductility. Therefore, P amount is suppressed to 0.03% or less. P amount is preferably 0.02% or less, and more preferably 0.015% or less. Although P is preferable to be as little as possible, it is normally contained by approximately 0.001% due to the restrictions on production steps.

S: 0.001-0.05%

S is an element inevitably contained in steel, is present as MnS in steel, deteriorates ductility, and therefore is an element harmful for cold working. Therefore, S amount is suppressed to 0.05% or less. S amount is preferably 0.04% or less, and more preferably 0.03% or less. However, because S has an action of improving machinability, it is useful to be contained by 0.001% or more. S amount is preferably 0.002% or more, and more preferably 0.003% or more.

Al: 0.01-0.1%

Al is useful as a deoxidizing element, and is an element useful for fixing solid-solutionized N present in steel as AlN. In order to exert such an effect effectively, Al amount was stipulated to be 0.01% or more. Al amount is preferably 0.013% or more, and more preferably 0.015% or more. On the other hand, when Al amount becomes excessively high, $Al_2O_3$ is formed excessively and deteriorates cold workability. Therefore, Al amount was stipulated to be 0.1% or less. Al amount is preferably 0.090% or less, and more preferably 0.080% or less.

N: 0.015% or Less (Exclusive of 0%)

N is an element inevitably contained in steel. When solid-solutionized N is contained in steel, hardness increase and ductility drop due to strain ageing are caused and cold workability is deteriorated. Therefore, N amount was stipulated to be 0.015% or less. N amount is preferably 0.013% or less, and more preferably 0.010% or less. Although N amount is preferable to be as little as possible, it is normally contained approximately 0.001% due to the restrictions on production steps.

Cr: Exceeding 0.5% and 2.0% or Less

Cr is an element effective in increasing the strength of the final product by improving quenchability of steel, and is an element useful in promoting spheroidizing by actions of improving stability of carbide in spheroidizing annealing and suppressing regenerated pearlite and so on because Cr is contained in spheroidized carbide by a small amount. In order to exert such an effect effectively, Cr amount was stipulated to be exceeding 0.5%. Cr amount is preferably 0.6% or more, and more preferably 0.7% or more. On the other hand, when Cr amount becomes excessively high, the strength increases excessively and cold workability is deteriorated. Further, Cr also has an action of lowering the combined area percentage of pearlite and pro-eutectoid ferrite. Therefore, Cr amount was stipulated to be 2.0% or less. Cr amount is preferably 1.8% or less, and more preferably 1.5% or less.

The basic chemical composition of the steel for a mechanical structure of the present invention is as described above, and the remainder is essentially iron. Also, "essentially iron" means that the trace components (Sb, Zn and the like for example) of a degree not impeding the properties of the steel of the present invention are permissible other than iron, and inevitable impurities (O, H and the like for example) other than P, S, N can be contained. Further, according to the necessity, the steel for a mechanical structure of the present invention may also contain one or more elements selected from the group consisting of Mo: 1% or less (exclusive of 0%), Ni: 3% or less (exclusive of 0%), Cu: 0.25% or less (exclusive of 0%), B: 0.010% or less (exclusive of 0%), Ti: 0.2% or less (exclusive of 0%), Nb: 0.2% or less (exclusive of 0%), and V: 0.5% or less (exclusive of 0%). The optional elements described above will be described separately into two groups described below.

First Group

One or more elements selected, from the group consisting of Mo: 1% or less (exclusive of 0%), Ni: 3% or less (exclusive of 0%), Cu: 0.25% or less (exclusive of 0%), and B: 0.010% or less (exclusive of 0%)

All of Mo, Ni, Cu and B are elements useful for increasing the strength of the final product by improving quenchability of steel, and can be used solely or by two kinds or more according to the necessity. In order to exert such an action effectively, any of Mo, Ni and Cu is preferably made 0.02% or more, and more preferably 0.05% or more. B is preferably 0.001% or more, and more preferably 0.002% or more. On the other hand, when the content of Mo, Ni, Cu and B becomes excessively high, the strength increases excessively and cold workability deteriorates. Therefore, Mo amount is preferably 1% or less (more preferably 0.90% or less, and further more preferably 0.80% or less), Ni amount is preferably 3% or less (more preferably 2.5% or less, and further more preferably 2.0% or less), Cu amount is preferably 0.25% or less (more preferably 0.20% or less, and further more preferably 0.15% or less), and B amount is preferably 0.010% or less (more preferably 0.007% or less, and further more preferably 0.005% or less).

Second Group

One or more elements selected from the group consisting of Ti: 0.2% or less (exclusive of 0%), Nb: 0.2% or less (exclusive of 0%), and V: 0.5% or less (exclusive of 0%)

Because Ti, Nb and V exert an effect of reducing deformation resistance by forming compounds with N and reducing solid-solutionized N, they can be used solely or by two kinds or more according to the necessity. In order to exert such an effect effectively, both of Ti and Nb are preferably 0.03% or more, and more preferably 0.05% or more, V is preferably 0.03% or more, and more preferably 0.05% or more. On the other hand, when the content of these elements becomes excessively high, the compounds formed draw increase of deformation resistance, and cold workability is deteriorated adversely. Therefore, both of Ti and Nb are preferably 0.2% or less, more preferably 0.18% or less, and further more preferably 0.15% or less. V is preferably 0.5% or less, more preferably 0.45% or less, and further more preferably 0.40% or less.

The steel for a mechanical structure of the present invention is aimed at wire rods or steel bars for example, and, although the diameter thereof is not particularly limited, it is approximately 5.0-20 mm for example.

The steel for a mechanical structure of the present invention is manufactured by casting according to an ordinary method first, blooming according to the necessity, and thereafter hot rolling. Also, it is important to properly adjust the finish rolling temperature in hot rolling and the cooling condition after finish rolling. More specifically, the finish rolling temperature is made 850-1,100° C., and, in cooling thereafter, cooling is executed to 720-780° C. with the average cooling rate of 10° C./s or more (cooling 1), cooling is thereafter executed to 680° C. or above with the average cooling rate of 1° C./s or less (cooling 2), and cooling is further executed to 640° C. or below with the average cooling rate of 0.5° C./s or less (cooling 3). Below, each condition will be described in detail.

Finish Rolling Temperature: 850-1,100° C.

The finish rolling temperature affects the average grain size of the ferrite (pro-eutectoid ferrite and ferrite in pearlite) described above. When the finish rolling temperature exceeds 1,100° C., the average grain size of the ferrite described above exceeds 25 μm, and, when the finish rolling temperature becomes below 850° C., the average grain size of the ferrite described above becomes less than 15 μm. The lower limit of the finish rolling temperature is preferably 900° C. or above, more preferably 950° C. or above, and the upper limit is preferably 1,050° C. or below, and more preferably 1,000° C. or below.

Cooling 1: Cooling to 720-780° C. with the Average Cooling Rate of 10° C./s or More When the average cooling rate after finish rolling is slow, because austenitic grains are coarsened and quenchability is enhanced, (i) pro-eutectoid ferrite of an amount satisfying the relationship of A>Ae described above cannot be secured, and/or (ii) 90 area % or more of the combined area percentage of pro-eutectoid ferrite and pearlite cannot be secured. Therefore, the average cooling rate after finish rolling is made 10° C./s or more. The average cooling rate is preferably 15° C./s or more, and more preferably 20° C./s or more. Although the upper limit is not particularly limited, the realistic range is 100° C./s or less normally.

Also, when the cooling stopping temperature in cooling 1 is low, the pro-eutectoid ferrite amount of an amount satisfying the relationship of A>Ae described above cannot be secured. Therefore, the cooling stopping temperature is made 720° C. or above. The lower limit of the cooling stopping temperature is preferably 730° C. or above, and more preferably 740° C. or above. On the other hand, when the cooling stopping temperature is high, because austenitic grains are coarsened and quenchability is enhanced, (i) pro-eutectoid ferrite of an amount satisfying the relationship of A>Ae described above cannot be secured, and/or (ii) 90 area % or more of the combined area percentage of pro-eutectoid ferrite and pearlite cannot be secured. Therefore the cooling stopping temperature is made 780° C. or below. The upper limit of the cooling stopping temperature is preferably 770° C. or below, and more preferably 760° C. or below.

Cooling 2: Cooling to 680° C. or Above with the Average Cooling Rate of 1° C./s or Less When the average cooling rate after cooling 1 is fast, pro-eutectoid ferrite of an amount satisfying the relationship of A>Ae described above cannot be secured. Therefore, the average cooling rate is made 1° C./s or less. The average cooling rate is preferably 0.8° C./s or less, and more preferably 0.6° C./s or less. Although the lower limit thereof is not particularly limited, it is approximately 0.1° C./s normally.

When the cooling stopping temperature in cooling 2 is low, the combined area percentage of pro-eutectoid ferrite and pearlite cannot be made 90 area % or more. Therefore, the cooling stopping temperature was made 680° C. or above. The cooling stopping temperature is preferably 685° C. or above, and more preferably 690° C. or above. The upper limit of the cooling stopping temperature should just be 780° C. or below, preferably 750° C. or below, more preferably 720° C. or below, and particularly preferably 700° C. or below.

Cooling 3: Cooling to 640° C. or Below with the Average Cooling Rate of 0.5° C./s or Less When the average cooling rate in cooling 3 is fast and when the cooling stopping temperature is high, the combined area percentage of pro-eutectoid ferrite and pearlite cannot be made 90 area % or more. The average cooling rate is 0.5° C./s or less, preferably 0.4° C./s or less, and more preferably 0.3° C./s or less. Although the lower limit thereof is not particularly limited, it is approximately 0.1° C./s normally. Also, the cooling stopping temperature is 640° C. or below, preferably 630° C. or below, and more preferably 620° C. or below. Further, although the lower limit of the cooling stopping temperature is not particularly limited, it is 500° C. or above, preferably 550° C. or above, and more preferably 600° C. or above for example.

After stopping (completing) cooling in the step of cooling 3, control of the cooling condition is not necessary, and cooling can be executed to an appropriate temperature, for example, the room temperature by appropriate cooling, for example, natural cooling and the like. Although spheroidizing annealing should just be executed after executing rolling and cooling with the conditions as described above, drawing may also be executed according to the necessity before spheroidizing annealing. Although the area reduction ratio of drawing is not particularly limited, it is approximately 5-30% for example.

The steel for a mechanical structure of the present invention is excellent in cold working because it can be sufficiently softened after spheroidizing annealing, and can be used suitably to various components such as components for automobiles, components for construction machines and the like manufactured by cold working such as cold forging, cold heading, cold rolling and the like.

Also, the present application is to claim the benefit of the right of priority based on the Japanese Patent Application No. 2012-98774 applied on Apr. 24, 2012. All of the contents of the specification of the Japanese Patent Application No. 2012-98774 applied on Apr. 24, 2012 are incorporated by reference into the present application.

EXAMPLES

The present invention will be described below more specifically referring to examples. The present invention is not to be limited by the examples below, it is a matter of course that the present invention can also be implemented with modifications being appropriately added within the range adaptable to the purposes described above and below, and any of them is to be included within the technical range of the present invention.

A wire rod with 8.0 mm-17 mm diameter is manufactured using steel having the chemical composition shown in Table 1 below with each condition (finish rolling temperature, average cooling rate and cooling stopping temperature in cooling 1-3) shown in Table 2 and Table 4.

With respect to each wire rod (rolled material) obtained, observation and measurement of the area percentage of the microstructure, measurement of the average grain size of ferrite, and measurement of the hardness after spheroidizing annealing were executed by the methods shown below. In all of them, a specimen in which each wire rod was embedded in a resin so that the vertical cross section (the cross section parallel to the axis) thereof could be observed was manufactured, and the position of D/4 (D is the diameter of the wire rod) was observed or measured.

1. Measurement of Average Grain Size of Ferrite

For measurement of the average grain size, an EBSP analyzer and an FE-SEM (Field Emission Type Scanning Electron Microscope) were used. The crystal grain was defined making the grain boundary in which crystal misorientation (oblique angle) exceeded 15°, which was the large angle grain boundary, the crystal grain boundary, and the average grain size of the crystal grain of ferrite (including both of pro-eutectoid ferrite and ferrite in pearlite) was measured. The measurement region was made optional 400 μm×400 μm, measurement step was made 0.7 μm interval, and the measurement point whose confidence index that showed reliability of the measuring orientation was 0.1 or less was deleted from the object of analysis.

2. Observation of Microstructure and Measurement of Area Percentage

With respect to each specimen, the microstructure was made appear by nital etching, and 10 fields of view were photographed with 400 magnifications using an optical microscope. The photos photographed were image-analyzed, and the combined area percentage of pro-eutectoid ferrite and pearlite (expressed as "rate of P+F" in the table) and the area percentage of pro-eutectoid ferrite were determined. Also, in analyzing the microstructure, the microstructure fraction was obtained by selecting 100 points at random with respect to each of the photos described above (in other words, 1,000 points in total were measured), and dividing the number of points in which each microstructure (the microstructure such as bainite, martensite and the like in addition to pro-eutectoid ferrite and pearlite) was present by the number of total points.

3. Measurement of Hardness after Spheroidizing Annealing

In measuring the hardness after spheroidizing annealing with respect to each specimen, 5 points were measured using a Vickers hardness tester with 1 kgf load, and the average value thereof (HV) was obtained. As the reference of the hardness at that time, the expression (2) below was used, and the case the average value described above was smaller than the reference value that was calculated by the expression (2) below was determined to have passed.

$$\text{Reference value of hardness}=88.4\times Ceq2+88.0 \quad (2)$$

where Ceq2=[C]+0.2×[Si]+0.2×[Mn], and [(element name)] means the content (mass %) of each element.

TABLE 1

| Steel | Chemical composition* (mass %) | | | | | | | | | | |
|---|---|---|---|---|---|---|---|---|---|---|---|
| kind | C | Si | Mn | P | S | Al | N | Cr | Others | Ceq | Ae |
| A | 0.35 | 0.18 | 0.69 | 0.018 | 0.013 | 0.028 | 0.005 | 0.96 | Mo: 0.16 | 0.52 | 27.6 |
| B | 0.29 | 0.25 | 0.68 | 0.017 | 0.015 | 0.026 | 0.005 | 1.08 | — | 0.47 | 31.5 |
| C | 0.34 | 0.20 | 0.61 | 0.015 | 0.017 | 0.019 | 0.004 | 0.67 | Ni: 1.31 | 0.47 | 31.9 |
| D | 0.35 | 0.21 | 0.68 | 0.008 | 0.007 | 0.015 | 0.003 | 1.08 | Ti : 0.01, V: 0.02 | 0.53 | 26.1 |
| E | 0.41 | 0.22 | 0.78 | 0.011 | 0.014 | 0.031 | 0.004 | 1.01 | Mo: 0.19 | 0.59 | 20.3 |
| F | 0.49 | 0.21 | 0.72 | 0.016 | 0.015 | 0.049 | 0.011 | 0.91 | Ni: 0.07, Cu: 0.09, V: 0.18 | 0.65 | 14.1 |
| G | 0.35 | 0.28 | 0.71 | 0.014 | 0.019 | 0.028 | 0.005 | 0.58 | B: 0.003, Ti : 0.04 | 0.48 | 30.5 |
| H | 0.38 | 0.17 | 0.81 | 0.017 | 0.015 | 0.027 | 0.004 | 0.91 | Mo: 0.10, Nb: 0.08 | 0.55 | 24.6 |
| I | 0.56 | 0.16 | 0.63 | 0.025 | 0.024 | 0.023 | 0.009 | 0.92 | Mo: 0.27 | 0.72 | 8.2 |
| J | 0.35 | 0.19 | 0.62 | 0.016 | 0.015 | 0.027 | 0.017 | 2.31 | — | 0.66 | 13.5 |

*The remainder is iron and inevitable impurities.

Example 1

Using the steel kind A shown in Table 1 above, using the Working Formastor Testing Apparatus of the laboratory, samples with different microstructure were manufactured respectively changing the finish working temperature (equivalent to the finish rolling temperature) and the cooling condition as shown in Table 2 below. At this time, the sample for the Working Formastor was made 8.0 mm diameter×12.0 mm, was equally split into two after the heat treatment, and was made a sample for investigating the microstructure (before spheroidizing annealing) and a sample for measuring the hardness after spheroidizing annealing respectively. With respect to these samples, the average grain size of ferrite, the area percentage of the microstructure, and the hardness after spheroidizing annealing were measured and were shown in Table 3 below. In spheroidizing annealing, each sample was sealed in vacuum respectively, was held at 760° C. for 6 hours in an atmospheric furnace, was thereafter cooled once to 680° C., was heated again to 760° C. (4 hours in total), was held at 760° C. for 6 hours, and was thereafter cooled to 680° C. with average cooling rate of 6° C./h. Also, the reference value of the hardness obtained based on the expression (2) above with respect to the steel kind A is HV134.

TABLE 2

| | | Manufacturing condition | | | | | | |
|---|---|---|---|---|---|---|---|---|
| | | | Cooling 1 | | Cooling 2 | | Cooling 3 | |
| Test No. | Steel kind | Finish working temperature (° C.) | Average cooling rate (° C./s) | Cooling stopping temperature (° C.) | Average cooling rate (° C./s) | Cooling stopping temperature (° C.) | Average cooling rate (° C./s) | Cooling stopping temperature (° C.) |
| 1 | A | 1100 | 40 | 760 | 0.3 | 690 | 0.1 | 640 |
| 2 | A | 1000 | 40 | 780 | 0.6 | 700 | 0.2 | 640 |
| 3 | A | 950 | 20 | 760 | 0.6 | 680 | 0.1 | 635 |
| 4 | A | 1000 | 40 | 720 | 0.4 | 680 | 0.4 | 580 |
| 5 | A | 800 | 40 | 760 | 0.4 | 690 | 0.2 | 640 |
| 6 | A | 1000 | 40 | 690 | 0.6 | 680 | 0.1 | 640 |
| 7 | A | 1050 | 40 | 720 | 0.4 | 700 | 0.9 | 580 |
| 8 | A | 1200 | 40 | 740 | 0.4 | 680 | 0.1 | 640 |

TABLE 3

| | | | Microstructure before spheroidizing annealing | | | Hardness |
|---|---|---|---|---|---|---|
| Test No. | Steel kind | Ae | Rate of P + F (area %) | Average grain size of ferrite* (μm) | Pro-eutectoid ferrite area percentage A (area %) | after spheroidizing annealing (HV) |
| 1 | A | 27.6 | 100 | 23 | 33.2 | 132 |
| 2 | A | 27.6 | 100 | 19 | 31.7 | 131 |
| 3 | A | 27.6 | 100 | 15 | 34.0 | 133 |
| 4 | A | 27.6 | 100 | 18 | 33.2 | 132 |
| 5 | A | 27.6 | 100 | 11 | 33.1 | 138 |
| 6 | A | 27.6 | 100 | 16 | 13.9 | 139 |
| 7 | A | 27.6 | 46.9 | — | 28.2 | 141 |
| 8 | A | 27.6 | 100 | 28 | 29.1 | 140 |

*Ferrite includes both of ferrite in pro-eutectoid ferrite and ferrite in pearlite In test Nos. 1-4 satisfying the requirement of the present invention, the composition is appropriate, the metal microstructure has pearlite and pro-eutectoid ferrite, the combined area percentage of them and the area percentage of pro-eutectoid ferrite are appropriate, and therefore sufficient softening is attained after spheroidizing annealing. On the other hand, in No. 5, because the finish working temperature was low, the average grain size of ferrite became small, in No. 6, the cooling stopping temperature in cooling 1 was low and the pro-eutectoid ferrite amount could not be secured, in No. 7, because the average cooling rate in cooling 3 was fast, the combined area percentage of pro-eutectoid ferrite and pearlite could not be secured, in No. 8, because the finish working temperature was high, the average grain size of ferrite became large, and in all of these cases, the hardness after spheroidizing annealing increased.

Example 2

Using the steel kind B-J shown in Table 1 above, samples with different microstructure were manufactured by rolling with the conditions (finish rolling temperature and cooling condition) shown in Table 4 below. Spheroidizing annealing was executed by a method similar to example 1. Also, with respect to test No. 15, after manufacturing the rolled material, spheroidizing annealing was executed after drawing with the area reduction ratio of approximately 20%. With respect to these samples, the average grain size of ferrite, the area percentage of the microstructure and the hardness after spheroidizing annealing were measured and were shown in Table 5 below.

TABLE 4

| | | Manufacturing condition | | | | | | |
|---|---|---|---|---|---|---|---|---|
| | | | Cooling 1 | | Cooling 2 | | Cooling 3 | |
| Test No. | Steel kind | Finish working temperature (° C.) | Average cooling rate (° C./s) | Cooling stopping temperature (° C.) | Average cooling rate (° C./s) | Cooling stopping temperature (° C.) | Average cooling rate (° C./s) | Cooling stopping temperature (° C.) |
| 9 | B | 1037 | 26 | 763 | 0.3 | 689 | 0.1 | 627 |
| 10 | C | 951 | 14 | 742 | 0.6 | 693 | 0.4 | 532 |
| 11 | D | 860 | 16 | 758 | 0.8 | 697 | 0.2 | 617 |
| 12 | F | 1013 | 21 | 756 | 0.6 | 703 | 0.1 | 626 |
| 13 | G | 927 | 16 | 741 | 0.6 | 691 | 0.2 | 628 |
| 14 | H | 1038 | 17 | 756 | 0.3 | 698 | 0.2 | 627 |
| 15 | I | 893 | 19 | 743 | 0.4 | 693 | 0.3 | 632 |
| 16 | B | 953 | 21 | 741 | 2.3 | 683 | 0.3 | 612 |
| 17 | C | 1032 | 5 | 734 | 0.8 | 689 | 0.4 | 657 |
| 18 | D | 1036 | 16 | 813 | 0.6 | 642 | 0.4 | 613 |
| 19 | J | 1063 | 19 | 747 | 0.6 | 686 | 0.3 | 632 |

TABLE 5

| Test No. | Steel kind | Ae | Microstructure before spheroidizing annealing: Rate of P + F (area %) | Average grain size of ferrite* (μm) | Pro-eutectoid ferrite area percentage A (area %) | Hardness after spheroidizing annealing (HV) | Reference value of hardness (HV) |
|---|---|---|---|---|---|---|---|
| 9 | B | 31.5 | 100 | 22 | 33.4 | 128 | 130 |
| 10 | C | 31.9 | 100 | 18 | 33.8 | 129 | 132 |
| 11 | D | 26.1 | 100 | 15 | 27.3 | 132 | 135 |
| 12 | F | 14.1 | 100 | 21 | 16.7 | 145 | 148 |
| 13 | G | 30.5 | 100 | 16 | 33.1 | 134 | 136 |
| 14 | H | 24.6 | 100 | 21 | 27.0 | 137 | 139 |
| 15 | I | 8.2 | 100 | 16 | 10.1 | 148 | 151 |
| 16 | B | 31.5 | 100 | 16 | 22.4 | 133 | 130 |
| 17 | C | 31.9 | 57.4 | — | 32.3 | 137 | 132 |
| 18 | D | 26.1 | 52.8 | — | 23.8 | 139 | 135 |
| 19 | J | 13.5 | 81.6 | — | 14.4 | 137 | 133 |

*Ferrite includes both of ferrite in pro-eutectoid ferrite and ferrite in pearlite In test Nos. 9-15 satisfying the requirement of the present invention, the composition is appropriate, the metal microstructure has pearlite and pro-eutectoid ferrite, the combined area percentage of them and the area percentage of pro-eutectoid ferrite are appropriate, and therefore sufficient softening is attained after spheroidizing annealing. On the other hand, in No. 16, because the average cooling rate in cooling 2 was fast, the pro-eutectoid ferrite amount could not be secured, in No. 17, because the average cooling rate in cooling 1 was slow and the cooling stopping temperature in cooling 3 was high, the combined area percentage of pro-eutectoid ferrite and pearlite was low, in No. 18, because the cooling stopping temperature in cooling 1 was high and the cooling stopping temperature in cooling 2 was low, the combined area percentage of pro-eutectoid ferrite and pearlite was low and the pro-eutectoid ferrite amount could not be secured, in No. 19, because the steel kind J with large amount of N and Cr was used, the combined area percentage of pro-eutectoid ferrite and pearlite was low, and in all of these cases, the hardness after spheroidizing annealing increased.

INDUSTRIAL APPLICABILITY

The present invention is useful for lowering deformation resistance of the steel for a mechanical structure for cold working. As the steel for a mechanical structure for cold working, various components such as components for automobiles, components for construction machines and the like for example (for example machine components, transmission components and the like such as a bolt, screw, nut, socket, ball joint, inner tube, torsion bar, clutch case, cage, housing, hub, cover, case, receive washer, tappet, saddle, valve, inner case, clutch, sleeve, outer lace, sprocket, core, stator, anvil, spider, rocker arm, body, flange, drum, joint, connector, pulley, metal fitting, yoke, mouthpiece, valve lifter, spark plug, pinion gear, steering shaft, common rail and the like) and the like can be cited.

The invention claimed is:

1. A steel, having a chemical composition comprising:
by mass %,
iron;
C: 0.2-0.6%;
Si: 0.01-0.5%;
Mn: 0.2-1.5%;
P: a positive amount of 0.03% or less;
S: 0.001-0.05%;
Al: 0.01-0.1%;
N: a positive amount of 0.015% or less; and
Cr: more than 0.5% and 2.0% or less, and
a metal microstructure comprising: pearlite and pro-eutectoid ferrite with a combined area percentage of the pearlite and the pro-eutectoid ferrite being 90% or more,
wherein
an average grain size of the pro-eutectoid ferrite and ferrite in the pearlite is 15-25 μm, and
a ratio of an area percentage A of the pro-eutectoid ferrite to Ae satisfies A/Ae>1, where Ae is calculated by expression (1):

$$Ae=(0.8-Ceq)\times 96.75 \quad (1)$$

where Ceq=[C]+0.1×[Si]+0.06×[Mn]+0.11×[Cr], and [C], [Si], [Mn], and [Cr] represent mass % of C, Si, Mn, Cr in the steel, respectively.

2. The steel according to claim 1, further comprising one or more elements selected from the group consisting of:
Mo: a positive amount of 1% or less;
Ni: a positive amount of 3% or less;
Cu: a positive amount of 0.25% or less;
B: a positive amount of 0.010% or less;
Ti: a positive amount of 0.2% or less;
Nb: a positive amount of 0.2% or less; and
V: a positive amount of 0.5% or less.

3. The steel according to claim 1, wherein A≥Ae+0.5.

4. The steel according to claim 1, wherein A≥Ae+1.5.

5. The steel according to claim 1, wherein A≤Ae+5.

6. The steel according to claim 1, wherein the steel further comprises Cu in a positive amount of 0.25% or less.

7. The steel according to claim 1, wherein the steel further comprises Nb in a positive amount of 0.2% or less.

8. The steel according to claim 1, wherein A≥Ae+1.0.

9. A method for manufacturing the steel according to claim 1, the method comprising
(i) finish rolling the steel at 850-1,100° C.;
(ii) cooling thereafter to 720-780° C. with an average cooling rate of 10° C./s or more;
(iii) cooling thereafter to 680° C. or above with an average cooling rate of 1° C./s or less; and
(iv) further cooling to 640° C. or below with an average cooling rate of 0.5° C./s or less.

10. The method according to claim 9, wherein
the steel is cooled at an average cooling rate of 20° C./s or more to 740 to 760° C. in the cooling (ii), the steel is cooled at an average cooling rate of 0.6° C./s or less to 690 to 700° C. in the cooling (iii), and the steel is cooled at an average cooling rate of 0.3° C./s or less to 600 to 620° C. in the cooling (iv).

11. The method according to claim 9, further comprising (v) cooling the steel to room temperature, and (vi) drawing and/or spheroidizing annealing, wherein the spheroidizing annealing is done after the finish rolling and the drawing.

12. The method according to claim 9, wherein the steel further comprises one or more elements selected from the group consisting of:

Mo: a positive amount of 1% or less;

Ni: a positive amount of 3% or less;

Cu: a positive amount of 0.25% or less;

B: a positive amount of 0.010% or less;

Ti: a positive amount of 0.2% or less;

Nb: a positive amount of 0.2% or less; and

V: a positive amount of 0.5% or less.

* * * * *